United States Patent [19]

Bolli

[11] Patent Number: 4,552,541

[45] Date of Patent: Nov. 12, 1985

[54] TOY BUILDING BLOCK WITH ELECTRICAL CONTACTING PORTIONS

[76] Inventor: Peter Bolli, Grabenackerstrasse 46, CH-6312 Steinhausen, Switzerland

[21] Appl. No.: 578,415

[22] Filed: Feb. 9, 1984

[30] Foreign Application Priority Data

Feb. 14, 1983 [CH] Switzerland ..... 814/83

[51] Int. Cl.[4] ..... A63H 33/04

[52] U.S. Cl. ..... 446/91; 446/128; 446/484

[58] Field of Search ..... 446/91, 90, 484, 128, 446/124, 125; 200/307

[56] References Cited

U.S. PATENT DOCUMENTS

| | | | |
|---|---|---|---|
| 3,005,282 | 10/1961 | Christiansen | 446/128 |
| 3,095,668 | 7/1963 | Dorsett | 446/92 |
| 3,237,341 | 3/1966 | Janning | 446/91 |
| 3,447,249 | 6/1969 | Greger | 446/91 |
| 3,484,984 | 12/1969 | Fischer | 446/91 |
| 3,696,548 | 10/1972 | Teller | 446/91 |
| 4,423,465 | 12/1983 | Teng-Ching et al. | 200/307 |

FOREIGN PATENT DOCUMENTS

| | | | |
|---|---|---|---|
| 2552587 | 5/1977 | Fed. Rep. of Germany | 446/91 |
| 455606 | 7/1968 | Switzerland | 446/91 |
| 965399 | 7/1964 | United Kingdom | 446/92 |

*Primary Examiner*—Robert A. Hafer
*Assistant Examiner*—Daniel Nolan

[57] ABSTRACT

A building block is provided having side walls and a top face with two rows of coupling pins on the one side of the top face and counter-coupling tubes on the other side for mechanically coupling two such building blocks by means of a clamping action. On their side faces, the coupling pins have electrically conducting regions, which extend over an angular range. The angular range of one row being turned by 180° relative to those of the other row. All the conducting regions are connected to a contact bar, which is arranged on the side of the counter-coupling tubes along one side wall. When two building blocks are coupled arbitrarily, at least one conducting region of each row of coupling pins of the one building block makes contact with a contact bar of the other building block in such a way, that a short circuit cannot occur in the two electrical circuits assigned to each row of coupling pins or each contact bar.

16 Claims, 50 Drawing Figures

TOY BUILDING BLOCK WITH ELECTRICAL CONTACTING PORTIONS

BACKGROUND OF THE INVENTION

The present invention relates to a building block for construction sets and especially to toy building blocks capable of being used to form electrical circuits.

In U.S. Pat. No. 3,005,282 there is disclosed a building block, in which a top face is provided on its one side with at least one row of coupling pins and on its other side with counter-coupling sockets for connection with the coupling pins of an adjacent similar building block. Such blocks are widely sold under the trade names "LEGO" and "DUPLO". It is furthermore known from Swiss Pat. No. 455,606 that at least some of the coupling pins may have electrically conducting surfaces or that the side of the face provided with counter-coupling socket may have electrically conducting connectors intended to establish electrical contact with the conducting surfaces of an adjacent, coupled, building block, when the two blocks are coupled together mechanically.

These known building blocks for constructing electrical circuits are expensive to manufacture, cannot be used universally with other building blocks of the same building block system and require the user to have at least an elementary knowledge of electrotechnology with respect to circuit diagrams.

In German patent application No. 2,552,587, a clamping building block with possibilities for electrical connections is disclosed, in which an electrical connection is produced at the places of contact between elevations and depressions of the building block by connecting contact sites mounted at these places. In this system, special attention has to be given to avoid short circuits when connections are made. How the contacting sites are mounted for is not explained in the patent.

It is an object of the present invention to provide a building block of the aforementioned type having electrical contacting means.

A further object is to provide such a block in which the coupling pins and counter-coupling sockets may can be combined at will with conventional building blocks of the same building block system which are without contacting means and the contact-making ability.

A still further object is to provide such a block in which the contact making ability is generally independent with respect to position of the block.

SUMMARY OF THE INVENTION

The above and other beneficial objects and advantages are attained in accordance with the present invention by providing a building block of the type described having at least one row of coupling pins on one side and one row of counter coupling socket on the opposite side. The surfaces of the coupling pins have electrically insulating and electrically conducting regions so that when the building block is coupled with another building block which has contacting sockets arranged parallel to the row of coupling pins of the first building block, in certain relative positions of the two building blocks an electrical connection is or is not established between the conducting coupling pins of the one building block and the contacting sockets of the other building block.

Preferably, the electrically conducting regions of the coupling pin are located at least on side faces of the coupling pins, which are perpendicular to a common plane of the coupling pins. The contacting sockets have a conducting area of contact which extends in the direction of the row of coupling pins and is perpendicular to said common plane. As a result, a reliable electrical contact can be achieved between the conducting regions of the coupling pins of the one building block and the contacting socket of another such building block when the two building blocks are coupled.

It is particularly advantageous if the electrically conducting regions on the coupling pins extend over an angular region of more than 90° and less than 270° about the longitudinal axis of the coupling pin and are formed and arranged equally for coupling pins of the same row. In this way, a contact, clearly defined in respect to position, is achieved between two building blocks which are coupled together. That is, there is contact in a particular mutual position, but not in a position offset by 90°.

The building blocks of the present invention may have two rows of coupling pins arranged in pairs next to each other and having conducting surfaces which, in the one row, lie in an angular region which is turned by 180° relative to that of the other row. The opposite side of the building block is provided with counter-coupling sockets and has a contacting strip for each of the two rows of coupling pins. The contacting strips make electric contact with the conducting surfaces of the associated rows of coupling pins. As a result, the same correspondence of electrical connections is always achieved so that a connection of the correct polarity is attained independently of how the two building blocks are coupled together.

Preferably, each contacting socket is constructed as an electrically conducting contact bar aligned with the corresponding row of contacting pins on the opposite side of the block. The bar is connected with the electrically conducting regions of the coupling pins of this row. In a building block consisting of a hollow body with parallel side walls, a conducting contact bar can be arranged either along each of two parallel side walls of the hollow body or on both sides of and along a center line equidistant from two parallel side walls of the hollow body. By means of these two variations, it is possible to provide contact bars in building blocks of practically any type.

BRIEF DESCRIPTION OF THE DRAWINGS

In the accompanying drawings:

FIGS. 18*a* to 29*a* are schematic representations of the straight-line coupling of a building block in accordance with the present invention with a similar block;

FIGS. 18*b* to 29*b* are schematic representations of the coupling at right angles of a building block in accordance with the present invention with another, similar block;

DETAILED DESCRIPTION OF THE PREFERRED EMBODIMENTS

Figure 1:
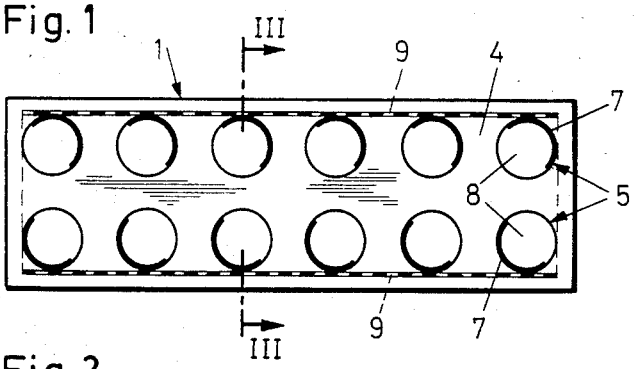
FIG. 1 is a top plan view of the upper side of a building block with two rows of six coupling pins each, whose side faces are partly electrically conductive.
Figure 2:
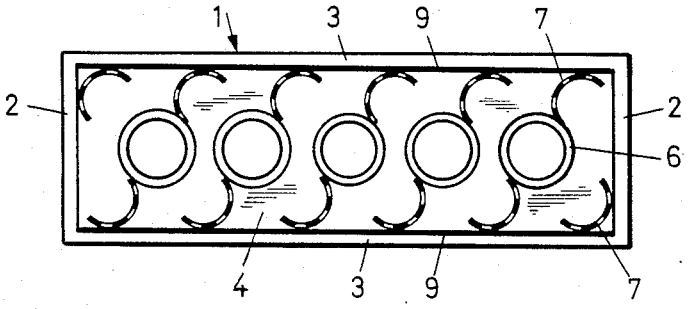
FIG. 2 is a bottom plan view of the underside of the building block of FIG. 1.
Figure 3:
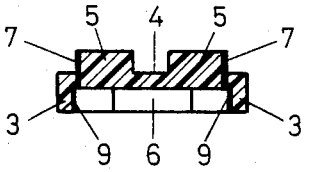
FIG. 3 is a sectional view along line III—III of FIG. 1.

Reference is now made to the drawings and to FIGS. 1 to 3 in particular wherein a toy building block generally of the type disclosed in U.S. Pat. No. 3,005,282 is shown comprising a box-shaped hollow body 1, consisting of an electrically insulating plastic material, with end walls 2, side walls 3 and a bottom wall 4, which is perpendicular to the end and side walls. On the external side of bottom wall 4, the building block has cylindrical coupling pins 5. In the interior of hollow body 1, counter-coupling sockets are formed, which have a clamping effect on the coupling pins and consist of tubes 6 projecting from the bottom wall 4 of hollow body 1.

In the example shown, the building block has two rows of six coupling pins 5, which are arranged in pairs next to each other, as well as five counter-coupling tubes 6. When two building blocks, such as those of FIGS. 1 to 3, or equivalent blocks of different lengths are coupled together, the coupling pins 5 of the one building block are wedged in the overlapping sections of the two building blocks between two counter coupling tubes and a side wall 3 or between a counter coupling tube 6, a side wall 3 and an end wall 2.

In the embodiment of the building block shown in FIGS. 1 to 3, the side faces or surfaces of the coupling pins 5 have an electrically conducting surface in the form of a metallic layer 7. In FIGS. 1 and 3, these conducting surfaces are represented by thick, full lines and in FIG. 2 by thick, broken lines, (since they are not visible).

The conducting layers 7 do not extend over the whole circumference of coupling pin 5, but only over an angular region of about 180°. This angular region may be smaller or larger, namely down to almost 90° on the one hand and up to almost 270° on the other. Moreover, as can be seen from FIG. 1, an imaginary dividing plane between the section of each coupling pin 5 which is provided with the conducting layer 7, and the remaining insulating section, forms an angle of approximately 45° with side walls 3. As a result of this extent and the position of the conducting layer 7 on each coupling pin 5, two of the four planes which can be placed against each coupling pin 5 so as to be parallel to end walls 2 and side walls 3, in each case lie against conducting layer 7 and the other two planes lie against the insulating section of the surface of coupling pin 5. The angular regions of the conducting layers 7 are all angularly aligned equally. However, the angular regions in one row of coupling pins are offset by 180° relative to those in the other row.

The conducting layers 7, together with the insulating sections 8 of the surface of each pin form a smooth cylindrical surface, so that the coupling pins 5 correspond in shape and dimensions to normal, fully insulating coupling pins of a conventional building block of this type.

It can furthermore be seen from FIGS. 1 to 3 that an electrically conducting, metallic, strap-shaped contact strip 9 is provided in the interior of the block along both side walls 3. In FIGS. 2 and 3, these contact strips are represented by thick, full lines and in FIG. 1 by thick broken lines.

A contact strip 9, which is electro-conductively connected with all conducting layers 7 of coupling pins 5 is assigned to each longitudinal row of coupling pins 5. The side walls 3 of the block and strip 9 are of a combined thickness so that together they form a wall thickness that is substantially equal to that of conventional similar building blocks.

Figure 4:
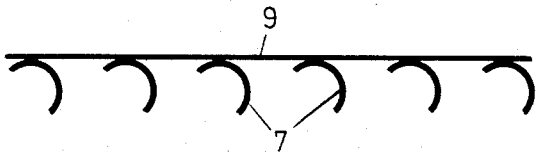
FIG. 4 is a plan view of the contacting strip of the building block of FIGS. 1 to 3.

A form of construction for the fabrication and configuration of the conducting layers 7 and the contact strips 9 is shown in FIG. 4. The conducting layers 7 consist of bent sheet metal pieces which are firmly connected electrically and mechanically with the associated strap-shaped contact strip 9. Preferably, conducting layers 7 and contact strips 9 are produced in one piece. Accordingly, a sheet metal strip, whose width is equal to the height of the building block (including coupling pins 5)

is incised at the appropriate places to a depth corresponding to the height of the coupling pins 5 (FIG. 3) and the incised regions are bent outwards as shown in FIG. 4 and are offset stepwise from the remaining section of the sheet metal strip (FIG. 3). This can be achieved without difficulty in one stamping operation. Appropriate slit-like openings in bottom wall 4 enable the unit of conducting layers 7 and contact strips 9 to be inserted in the preformed plastic hollow body 1.

It can be seen that when two similar building blocks, (as shown in FIGS. 1 to 3), are placed on top of one another and coupled, whether so as to overlap completely or only partly in the longitudinal direction, the conducting layers 7 of the one row of coupling pins 5 of the one building block in each case make electrical contact with a contact strip 9 of the other building block. This also applies to the conducting layers of the other row of coupling pins and the other contact strip. If the one building block is coupled to the other block in a perpendicular position, the circuits, assigned to the two rows of coupling pins, are maintained and remain separate, as is explained below with reference to FIG. 8.

Figure 8:
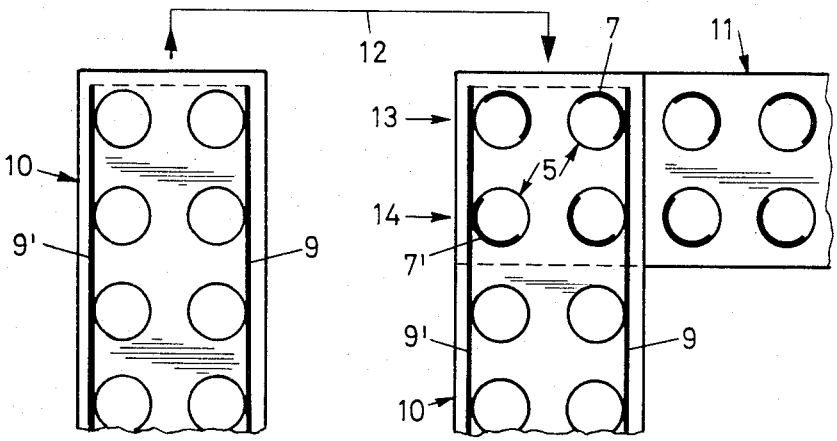
FIG. 8 is a representation of two building blocks of FIGS. 1 to 3, which are coupled together.

According to FIG. 8, a first building block 10 is coupled at right angles with a second building block 11 by placing the first on the second, as indicated by arrow 12. In this case, the conducting layers 7 or 7' of coupling pins 5 of building block 11 and contact strips 9 or 9' of building block 11 cooperate the process of making electrical contact. (Note that coupling pins 5 are depicted as being transparent pins in the overlapping regions of building blocks 10 and 11 to facilitate the following description). It can be seen that in this case the one contact strip 9 of building block 10 makes electrical contact with the conducting layer 7 of one of the coupling pins 5 of the one row 13 of building block 11, but not with any conducting layer 7' of a coupling pin 5 of the other row 14. The other contact strip 9' of building block 10 makes electrical contact only with the conducting layer 7' of one of the coupling pins 5 of the other row 14 of building block 11. Thus, in both building blocks 10 and 11 the two rows of coupling pins which are connected electrically by the corresponding contact strips, are separated electrically no matter how the one building block 10 is coupled with the other building block 11. Electrical connections can thus be established, even by complete novices such as children, without running anyrisk of causing a short circuit.

Figure 5:
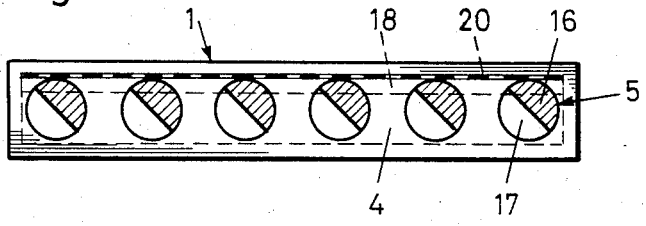
FIG. 5 is a top plan view of a building block with a row of six coupling pins having partly are electrically conductive side faces.
Figure 6:
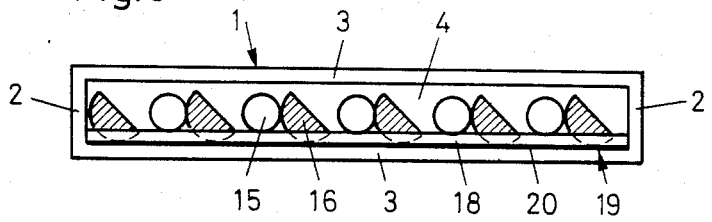
FIG. 6 is a bottom plan view of the building block of FIG. 5.
Figure 7:
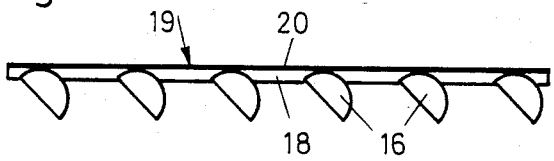
FIG. 7 is a plan view of the contacting device of the building block of FIGS. 5 and 6.

The toy building block, shown in FIGS. 5 and 6, also has a box-shaped hollow body 1 with end walls 2, side walls 3 and a bottom wall 4. However, this building block has only a single row of cylindrical coupling pins 5 (FIG. 5), cylindrical pins 15 being formed in the interior of the hollow body 1 on the bottom wall 4 as counter-coupling sockets (FIG. 6). The conducting surface extending over a section of the side face of each coupling pin 5, is formed in this building block by having each coupling pin 5 comprise a metallic section 16 and an insulating section 17. The insulating section is formed in the bottom wall 4. Sections 16 and 17 lie next to one another along a diametrical dividing plane, which is inclined at an angle of 45° to side walls 3. The side faces of coupling pin 5, are thus insulated over 180° and conducting over 180°. Metallic sections 16 protrude through bottom wall 4 (FIG. 6) and are connected, (e.g. soldered), to a metallic strap 19, which is adjacent to bottom wall 4. Metallic strap 19 has an "L" shaped cross-section. The sections 16 extend from one leg 18 of the strap 19. The other leg 20 of the strap 19 forms a contact strip, which extends along the one side wall 3. The contacting strip, comprising L strap 19 with legs 18 and 20 as well as of metallic parts 16 of the coupling pins, which are attached to leg 18, is shown in FIG. 7.

In contrast to the building block of FIGS. 1 and 2, only a single-pole electrical connection can be produced with the building block of FIGS. 5 and 6. However, it enables an electrical connection to be established easily with a further building block having similar contacting devices and can also be combined at will with a conventional building block consisting exclusively of insulating plastic. Moreover, a switching action can be produced with the building block of FIGS. 5 and 6, as will be explained below by means of FIG. 9.

Figure 9:
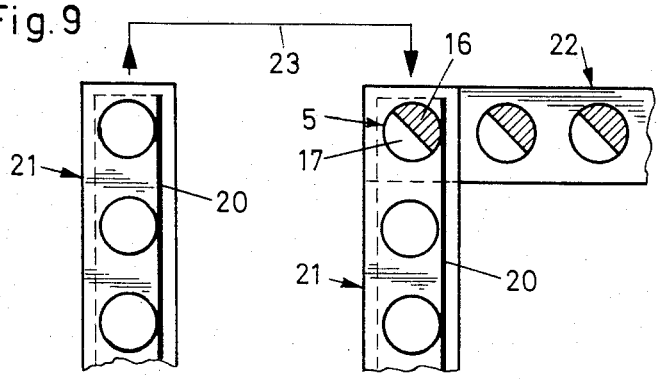
FIG. 9 is a representation of two building blocks of FIGS. 5 and 6, coupled together.

In accordance with FIG. 9, a first building block 21 is coupled together with and perpendicularly to a second building block 22, by placing the first on the second as indicated by arrow 23 and as was described for the building blocks of FIGS. 1 and 2 by means of FIG. 8. By so doing, electrical contact is established between leg 20 of the contact strip of building block 21 and the metallic section 16 of coupling pin 5 of building block 22. Accordingly, there is an electrical connection between the conducting sections 16 of coupling pins 5 of both building blocks or between their contact strips. If now building block 21 is turned clockwise by 90° or building block 22 is turned counterclockwise by 90° then the contact strip of building block 21 will be adjacent to the insulating section 17 of coupling pin 5 of building block 22. The said electrical connection is thus interrupted.

Figure 10:
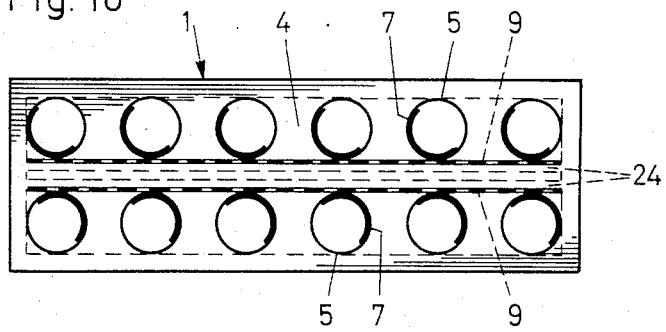
FIG. 10 is a top plan view of a further embodiment of a building block having two rows of six coupling pins each.
Figure 11:
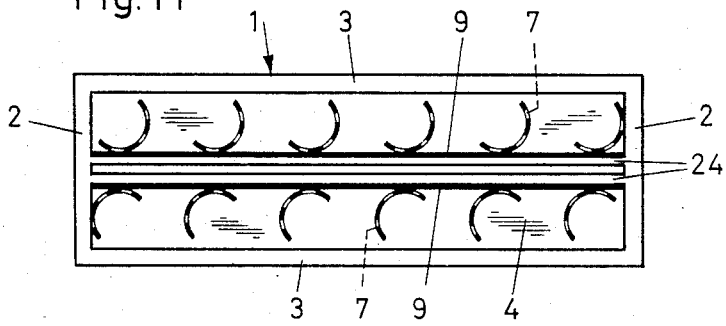
FIG. 11 is a bottom plan view of the building block of FIG. 10.

A further embodiment of the present invention is shown in FIGS. 10 and 11, wherein the hollow body 1 differs from that of FIGS. 1 and 2 by the fact that in this embodiment the interior of the hollow body has two parallel longitudinal walls 24. The walls 24 are formed at the interior face of bottom wall 4 and extend to the end walls 2. The walls 24 cooperate in defining counter-coupling sockets for coupling pins 5, which are present in two rows. In this embodiment two contact strips 9 are provided. The conducting layers 7 for the respective coupling pins 5 are electrically separated from each other along the parallel walls 24. The two conducting layers are equidistant from the two parallel side walls 3 of hollow body 1. The operation of the building block of FIGS. 10 and 11 the already described building block of FIGS. 1 and 2.

It should also be noted that the contact arrangement shown in FIGS. 4 and 7, can also be used as an alternative for the building blocks of FIGS. 1 and 2, 5 and 6, as well as 10 and 11.

Figure 12:
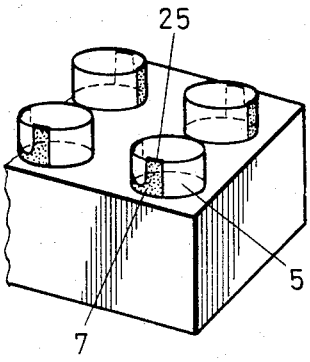
FIG. 12 is a perspective view of the upper side of a section of a building block of FIG. 1, in which the conducting regions of the coupling pins are elastic.
Figure 13:
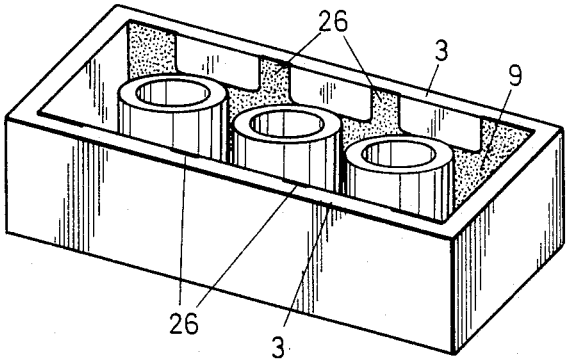
FIG. 13 is a perspective view of the underside of a building block similar to that of FIG. 2, in which the contact strips are elastic.

Although normally a contact pressure is produced automatically as a result of the elastic side walls of the building block, the upper or lower side of a building block is shown in FIGS. 12 and 13, in which the conductive surfaces 7 of coupling pin 5 or the contact strips 9 are resilient. For this purpose, the conducting surfaces of coupling pins 5 extend as fingers 25 only at the designated contact sites over the complete height of the contact pins (FIG. 12). Similarly, the contact strips may extend as fingers 26 over the complete height of side walls 3 (FIG. 13). A resilient contact is achieved through fingers 25 and 26.

Figure 14:
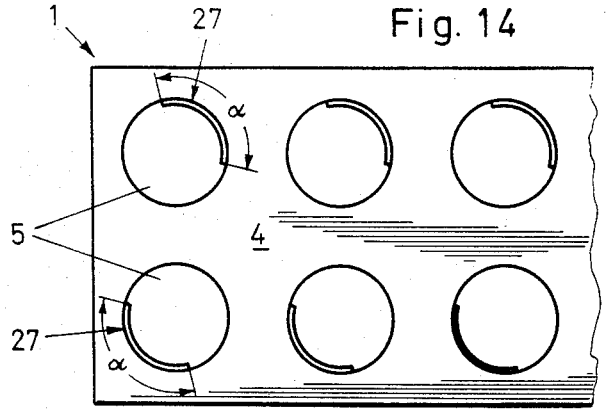
FIG. 14 is a plan view of a further embodiment of a building block with conducting regions on the side faces of its coupling pins.
Figure 15:
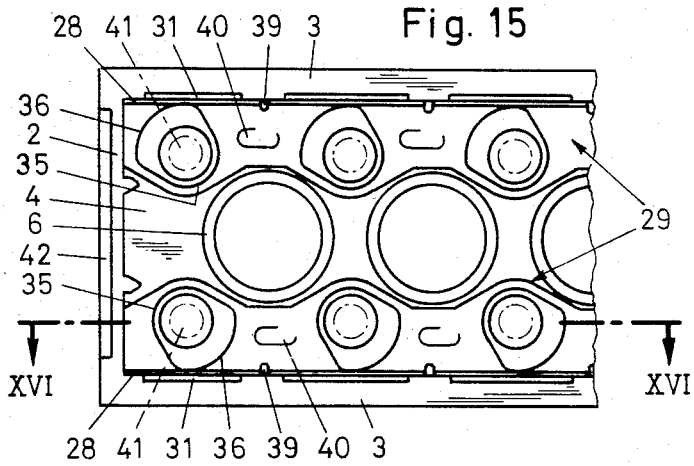
FIG. 15 is a projection of the underside of the building block of FIG. 14.
Figure 16:
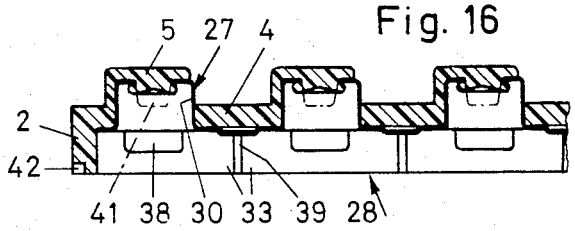
FIG. 16 is a longitudinal sectional view through the building block of FIGS. 14 and 15 along the lines XVI—XVI.
Figure 17:
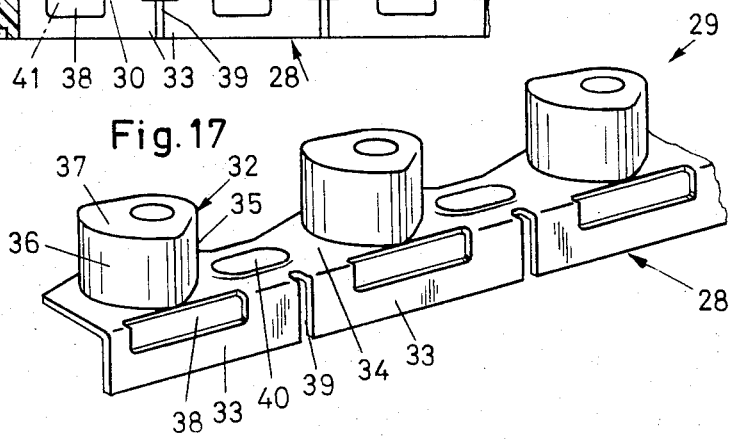
FIG. 17 is a perspective view of a one-piece contacting device for the building block of FIGS. 14 to 16.

FIGS. 14 to 16 show a further embodiment of the present building block, whose one-piece contacting device is shown in perspective in FIG. 17. This building block has a box-shaped hollow body 1, consisting of an electrically insulating plastic material, with end walls 2

(only one end wall is shown), side walls 3, a bottom wall 4, which is perpendicular to the end and side walls, and, two rows of cylindrical coupling pins 5. Counter-coupling sockets are provided in the form of cylindrical tubes 6 (such as those shown in FIG. 2) formed in the interior of hollow body 1.

As can be seen from FIGS. 14 and 16, coupling pins 5 have an electrically conducting surface region 27, extending over an angular range a of about 110° to 120°. The coupling pins 5 of the same row, have the same position relative to the end and side walls 2 and 3 of hollow body 1. The building block of this embodiment has a contact strip 28 in the interior of hollow body 1, which extends along one side wall 3 and which, in a manner explained below, is in electrical contact with the conducting regions 27 of coupling pins 5. The general construction of the building block shown and its general function, with exception of the size of the building block and the number of coupling pins, is in agreement with the examples of the operation described previously.

The building block comprises two one-piece parts, namely the plastic part forming hollow body 1 (FIGS. 15, 16) and a metallic part 29 (FIG. 17) which forms a coherent contacting device and which is inserted into hollow body 1. As can be seen especially from FIG. 16, the coupling pins 5 are hollow and are moreover cutout at their surfaces at places labelled 30. The inner surfaces of side walls 3 are provided with narrow recesses 31.

The contacting device 29 (FIG. 17), which is formed in one piece from a piece of sheet metal (e.g. brass plate or nickel silver) by deep drawing, stamping and bending, consists of several, essentially hollow cylindrical contact parts 32, a common contact bar 33 and connecting sections 34 between contact parts 32 and contact bar 33. The number of cylindrical contact parts 32 is determined by the number of coupling pins. Contact parts 32 have a hollow cylindrical region 35 of smaller radius and a hollow cylindrical region 36 of larger radius. The first mentioned region 35 is intended to lie against the inner surface of hollow coupling pin 5 (FIG. 15), while the second region 36 mentioned is intended to form the electrically conducting surface region 27 (FIGS. 14, 16) in the cutout of coupling pin 5 at location 30. A flange edge 37 is formed at the upper side of contact part 32, in order to anchor contact device 29 with the two hollow coupling pins 5. Contact bar 33 is provided with openings or breakthroughs 38 at the location of the contact parts 32 and with slits 39 in between. Reinforcing pleats 40 strengthen the connecting parts 34, which are weakened by slits 39.

The building block of FIGS. 14 to 16 is formed of a plastic, hollow body 1, in which the inner sides of the faces of the coupling pin have a truncated (or cylindrical) projection 41, which is shown by broken lines in FIG. 15 and whose external diameter is smaller than the opening diameter of the flanged edge 37 of contact part 32 (FIG. 17). Contact device 29 of FIG. 17 is inserted into the interior of this hollow body 1 (FIG. 15) and is held fast at the adjacent side wall 3 by counter-coupling tubes 6. Ultrasonic energy is then applied under axial pressure on the projections 41 by means of an ultrasonic tool, so that the projections spread out radially and, after cooling, hold contact device 29 firmly.

When two similar building blocks are coupled together, the regions of contact bar 33, which are provided with breakthroughs 38 and separated by slits 40, can yield elastically in the recesses 31 of the side wall 3 in question, so that a secure contact is made with the conducting regions of coupling pins 5 of the coupled building block.

Recess 42 in end wall 2, (shown in FIG. 16) serves to facilitate separation of two building blocks which are coupled together flush. Contacting device 29 of FIG. 17 is preferably produced in the form of a long strip with numerous contact sections 32. A segment with the required number of contact sections 32 for each building block may then be severed from this strip. Obviously, building blocks with only one row of coupling pins 5 can also be equipped with contact devices of FIG. 17.

The shape of the conducting layers as well as that of the contact strips of the contact devices described, especially those of FIG. 4, can be matched readily to the particular construction of the counter-coupling sockets of types of building. This is explained briefly below by means of the schematic overview shown in FIGS. 18 to 29.

In all the schematic drawings of FIGS. 18 to 29, the coupling pins 5 for in each case two coupled building blocks, each with two rows of coupling pins, are shown by circles or squares. The conducting side faces 7 of the coupling pins of one building block, which extend over about 180°, are indicated by black zones. The contact strips 9 of the other building block are indicated by thin lines. FIGS. 18, 20, 22, 24, 26 and 28 in each case show contact strips, which essentially are arranged along both side walls of the hollow body. In the building blocks of FIGS. 19, 21, 23, 25, 27 and 29, the contact strips are arranged on either side of a center line of the hollow body. Finally, two longitudinally coupled building blocks with the contacts involved are shown in FIGS. 18*a*, to 29*a*, while building blocks of the same type, which are coupled together at right angles to each other, and the contacts involved are shown in FIGS. 18*b* to 29*b*.

Figure 18A:
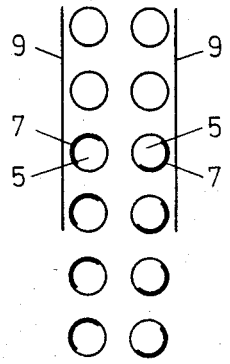
Figure 19A:
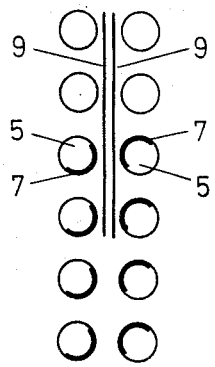
Figure 18B:
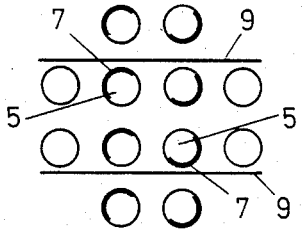
Figure 19B:
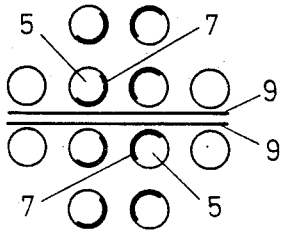

FIGS. 18*a* and 18*b* correspond to FIGS. 1 and 2 or 8, and need not be explained further. FIG. 19*a* corresponds to two building blocks of FIGS. 10 and 11 with longitudinal coupling, while FIG. 19*b* represents the contact established when two building blocks of FIGS. 10 and 11 are coupled at right angles to each other.

Figure 20A:
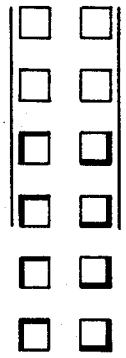
Figure 21A:
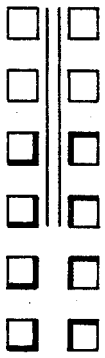
Figure 20B:
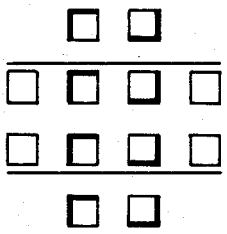
Figure 21B:
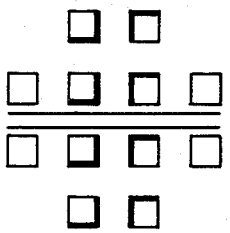
Figure 22A:
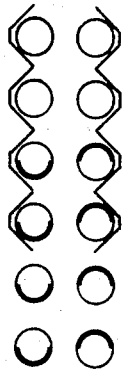
Figure 23A:
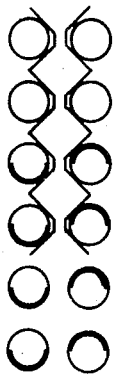
Figure 22B:
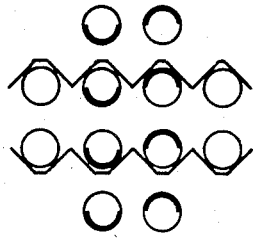
Figure 23B:
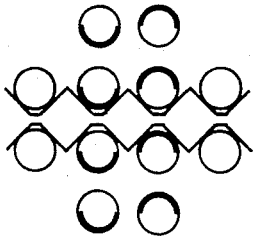
Figure 24A:
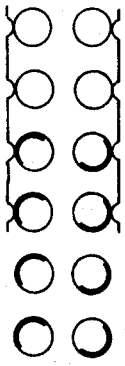
Figure 25A:
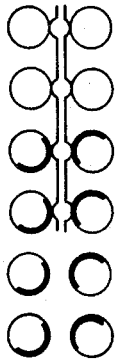
Figure 24B:
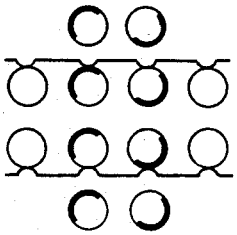
Figure 25B:
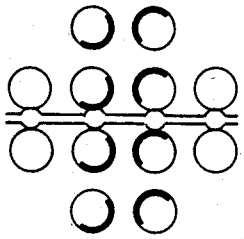
Figure 26A:
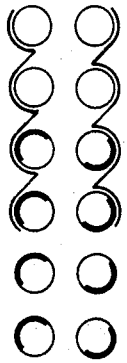
Figure 27A:
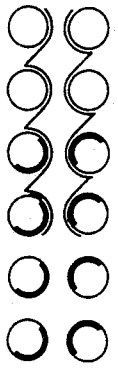
Figure 26B:
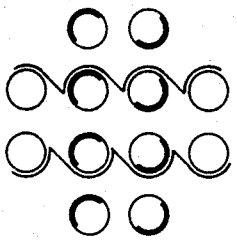
Figure 27B:
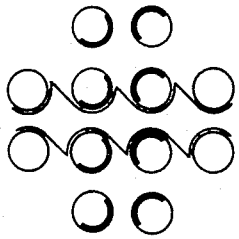
Figure 28A:
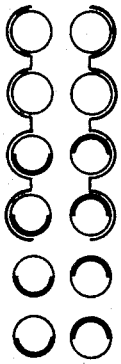
Figure 29A:
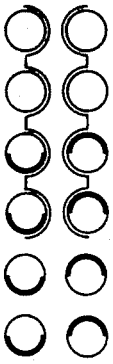
Figure 28B:
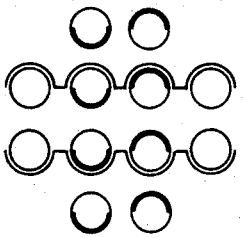
Figure 29B:
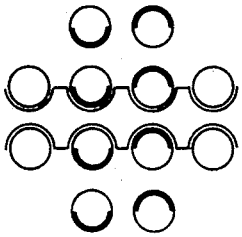

Toy building blocks are known which have contacting pins with a square cross section instead of a cylindrical one. For these building blocks contact devices of the present invention can be arranged, as is shown in FIGS. 20 and 21. Two side faces of each of these coupling pins are provided in the manner described with conducting surfaces. The surfaces make electrical contact with straight contact strips arranged in the interior of the hollow body. It should be appreciated that the conducting surface on the coupling pin extends over an angular range of 180°.

The other arrangements of contact devices, shown in FIGS. 21 to 29, make use of contact strips which are bent repeatedly. This is done out of consideration for the special constructions of the counter-coupling sockets of the building blocks in question. Thus, instead of the counter-coupling tubes of FIG. 2, relatively thin pins for example, which are formed in large numbers and which can be solid or slit, have heretofore been suggested for engagement with coupling pins. In accordance with the embodiments of FIGS. 24 to 27, the dividing plane between the conducting and insulating side faces of each coupling pin forms an angle of 45° with the side faces of the hollow body. In the embodiments of FIGS. 22, 23, 28 and 29 however, this dividing plane, out of consideration for the deflection of the contact strips, is perpendicular to the side walls of the hollow body.

Figure 30:
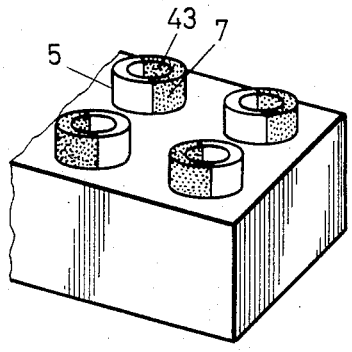
FIG. 30 is a perspective view of the top side of a building block of FIG. 1, in which the coupling pins are in the form of contact sockets.

A toy building block in the manner of the building block of FIG. 1 is partially shown in FIG. 30 in a perspective exterior view. In this embodiment of a building block each coupling pin 5 has a central borehole. A conducting layer 7 is provided over a segment of the exterior surface of the pin. A conducting surface 43 is also provided about that segment of the borehole within the angular range of the conducting surface 7. The segment 43 is electrically connected to conducting surface 7 over the front face of the pin 5 as shown. Preferably therefore, the conducting section of coupling pin 5 consists of a metal piece analogous to the the metallic part 16 of the building block of FIGS. 5 and 6. A plug pin for supplying electrical current to or tapping it from the building block may thus be introduced into the borehole of coupling pin 5.

Figure 31:
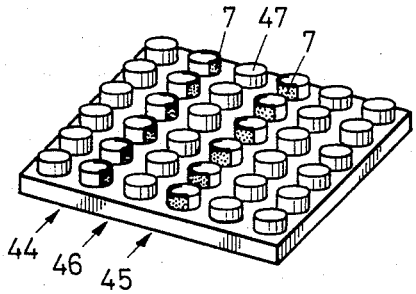
FIG. 31 and FIG. 32 are perspective views of the upper side of plate-like building blocks having several rows of coupling pins.
Figure 32:
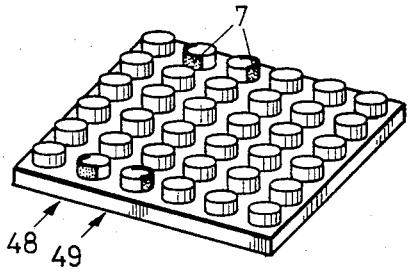

The contract device of the present invention may also be adapted for a plate-like building block provided with a large number of coupling pins. Some of the contacts may be used for providing current to or tapping it from a constructed model. A building block plate of this type is shown as example in FIG. 31. The plate has two rows 44 and 45 of coupling pins provided with conducting surfaces. The two rows being separated by a row 46 of completely insulating coupling pins 47. In the two adjacent rows 48 and 49 of the building block of FIG. 32, only the two coupling pins at the edge are provided with conducting surfaces 7. In the two building blocks shown, the conducting surfaces 7 of the coupling pins of each row 44, 45, 48 and 49 are electrically connected to each other, for example through contact strips arranged on the hollow underside of the building blocks, which are not shown.

The contacts described, namely conducting side faces on the coupling pins and contact strips in a hollow space containing counter-coupling sockets, can also be provided individually in building blocks of a particular shape and a particular function. Appropriate forms of construction are shown in perspective in FIGS. 33 to 38.

Figure 33:
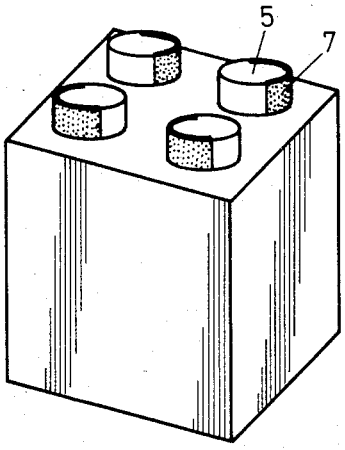
FIG. 33 is a perspective view of a box-shaped building block with four coupling pins, which is intended to hold electronic and/or electric components.

A box-shaped building block is shown in FIG. 33. This block is contactless on its underside, which is not visible, and which is intended to hold an electronic or electric component. For supplying bipolar current to this component, the upper side of the building block has four coupling pins 5, which have oriented, partially conducting side faces 7 in two rows turned by 180°, as has already been described previously, e.g. by means of FIG. 1. The conducting side faces of each row are joined to connecting elements for the component to be accommodated, which are arranged in the interior of the building block. The current is supplied by a further building block, which has two contact strips, as shown in FIGS. 1 and 2 for example, and which is connected to the coupling pins. As has already been explained, in so doing, it is not possible to cause a short circuit.

Figure 34:
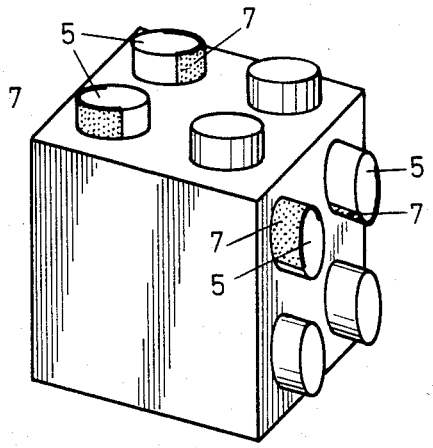
FIG. 34 is a perspective view of a cube-shaped building block with coupling pins arranged on two adjacent faces.

A similar construction is shown by the building block of FIG. 34, which has coupling pins 5 on two sides. Some of pins 5 are provided with conducting side faces. In this way, it is possible to supply current to the component to be accommodated in the building block selectively from two mutually perpendicular planes or to continue the current conduction while at the same time supplying current to a component.

Figure 35:
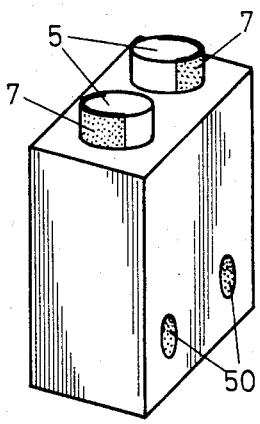
FIG. 35 is a perspective view of an elongated building block which is provided with two coupling pins and connector holes.

A toy building block is shown in FIG. 35, which can be used as a wall unit in construction models. At its upper front face, the building block has two coupling pins 5, which are provided with partially conducting side faces 7, which turned relative to each other by 180°. The lower front face of the building block (not shown) contains two contact strips, each of which is connected with the conducting side face 7 of one of the coupling pins 5, so that several building blocks of the type shown can be put together and, in so doing, bipolar, short-circuit-proof connections can be established at the same time. The building block shown also has two boreholes 50, which are provided with inner conducting surfaces. The inner conducting surface of each borehole is connected with one of the two contact strips. Thus, connecting plug pins of a toy lamp or the like can be plugged into boreholes 50.

Figure 36:
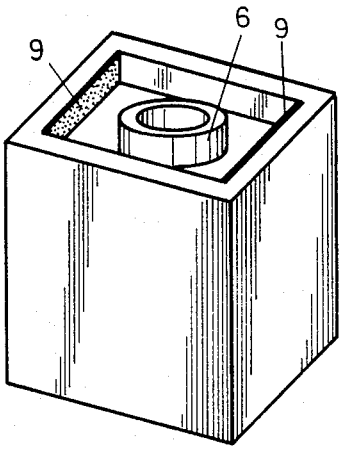
FIG. 36 is a perspective view of a box-shaped building block with a counter-coupled tube and contact strips, which is intended to hold electronic and/or electric components.

FIG. 36, like FIG. 33, shows a box-shaped building block, which, however is provided at its upper side with a depression with a counter-coupling tube 6, as well as two contact strips 9. This building block is also useful for accepting an electronic or electric component. The component may be supplied with current via the contact strips 9 and coupling pins from a coupled, connecting building block.

Figure 37:
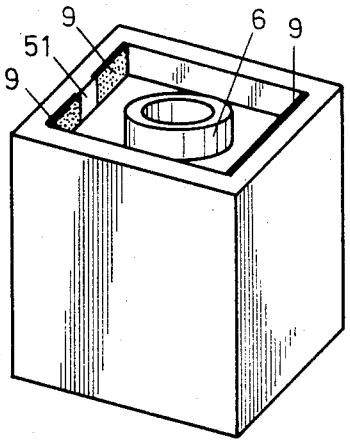
FIG. 37 is a perspective view of a building block similar to that of FIG. 32, but with discontinuous contact strips; and, FIG. 38 is a perspective view of a cube-shaped building block, which has coupling pins on one face and a counter-coupling tube and contact strips on an adjoining side.

A similar building block is shown in FIG. 37, in which the one contact strip 9 has a interruption 51. A switch, installed in the same building block, can be connected to the two separate sections of this contact strip.

Figure 38:
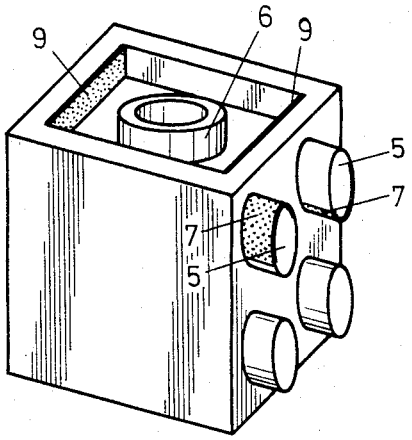

Finally, a box-shaped building block is shown in FIG. 38, which on two mutually perpendicular sides combines the arrangement of coupling pins 5 of FIGS. 33 and 34 with the arrangement of contact strips 9.

It is evident that the building block of the present invention can have numerous shapes, sizes and arrangement variations of its contacting devices. In each case, it is possible to establish electrical connections with these building blocks without instructions, training or knowledge, and without running the risk of causing a short circuit. A further advantageous use of the inventive building blocks permits the of electrical connection of a base plate, which is equipped with coupling pins, to another such base plate or with a source of current. Coupling pins of the base plate, at least those adjacent to the edges, being electrically conducting and connected electrically to each other to form one or serveral electric circuits.

I claim:

1. A toy building block having on one face thereof at least one row of mechanical coupling pins and opposite thereto mechanical counter-coupling sockets, at least a plurality of said coupling pins in said row having electrically conducting and electrically insulating regions angularly spaced from each other, said electrically conducting region of each of said pins in said row being disposed at the same angular orientation, and at least one contact member within said block and forming a portion of said socket, said contact member being electrically connected to said electrically conducting regions of a plurality of coupling pins in said row and having electrically conducting surfaces extending in a direction parallel to the longitudinal direction of said row of coupling pins.

2. The building block in accordance with claim 1, wherein said electrically conducting regions on the coupling pins are disposed at one side faces thereof, said side faces being oriented vertically with respect to said one face of said building block.

3. The building block in accordance with claim 2, wherein said electrically conducting surfaces of said contact member further extend vertically with respect to said one face of said building block.

4. The building block in accordance with claim 1 wherein said electrically conducting regions on the coupling pins extend over an angular range of more than 90° and less than 270° about the longitudinal axes of the coupling pins, said electrically conducting regions being formed and disposed in the same manner on the coupling pins of said row.

5. The building block in accordance with claim 4 wherein in a first row the electrically conducting regions of each of said pins are disposed at the same angular orientation and further comprising a second row of coupling pins substantially identical to said first row of coupling pins arranged in pairs therewith, the electrically conducting regions of said second row of pins being offset by 180° relative to the angular orientation of said first row.

6. The building block in accordance with claim 5 wherein said contact member is in the form of a strip or bar.

7. The building block in accordance with claim 6 wherein said face is perpendicular to a pair of opposed side walls, said first and second rows of coupling pins extend parallel to said side walls, a contact member is disposed within said housing for said second row of pins, said last mentioned contact member forming at least a portion of a socket for said second row of pins, and said first and second contact members extend along opposite ones of said side walls.

8. The building block in accordance with claim 6 wherein said face is perpendicular to a pair of opposed side walls, said first and second rows of coupling pins extend parallel to said side walls, a contact member is disposed within said housing for said second row of pins, said last mentioned member forming at least a portion of a socket for said second row of pins, and the contact member for said first and second rows of pins are disposed on opposite sides of a center line of said housing, equidistant from opposite ones of said side walls.

9. The building block in accordance with claims 1,5,6,7 or 8 wherein said conducting region is formed by a resilient member.

10. The building block in accordance with claims 1,5,6,7, or 8 wherein said coupling pins are formed of an insulating material, said conducting regions comprise separate pieces and all the pieces for the coupling pins of the same row are connected to an associated contact strip.

11. The building block in accordance with claims 1,5,6,7 or 8 wherein said coupling pins and said block are formed of an insulating material, said conducting regions comprise separate pieces, all the pieces of the coupling pins of the same row are formed in one piece with an associated contact strip and said pieces and said contact strip are embedded in said coupling pins and block.

12. The building block in accordance with claims 1,5,6,7 or 8 wherein each coupling pin conducting region is separated from the insulating region along a plane perpendicular to said face, said conducting regions extending through said face and further comprising an L-section strap having one leg engaging said conducting regions and those other leg is disposed below said face.

13. The building block in accordance with claims 7 or 8 wherein said pins are formed of an insulating material, said conducting regions comprise separate pieces, all the pieces for the coupling pins of the same row are formed in one piece with an associated contact strip and a plane dividing said conducting region from said insulating region extends at an angle of approximately 45° with said side walls.

14. The building block in accordance with claims 1,5,6,7 or 8 wherein said coupling pins are hollow and cylindrically shaped, a cutout extends through each of said pins and said conducting regions comprise a sleeve-shaped metal piece inserted into the hollow space of said pins, said sleeve having a region of smaller radius adjacent the inner face of the pin cylindrical wall and a region of larger radius extending through the cut-out in the cylindrical wall.

15. The building block in accordance with claims 1,5,6,7 or 8 wherein said coupling pins are hollow and cylindrically shaped, a cutout extending through each of said pins and said conducting region comprises a sleeve-shaped metal piece inserted into the hollow space of said pins, said sleeve having a region of smaller radius adjacent the inner face of the pin cylindrical wall and a region of larger radius extending through the cut-out in the cylindrical wall wherein the end of the sleeve-shaped metal piece adjacent to the front wall of the coupling pin has a ring-shaped internal flange into whose opening an internal projection of the coupling pin extends in order to anchor the sleeve-shaped metal piece to the coupling pin.

16. The building block in accordance with claim 1 comprising a box-shaped hollow body for accommodating at least one electronic or electric component, contact means on the internal surface of said block for connection with said component, and connecting means extending between the conducting region of said pin and said connecting means.

* * * * *

UNITED STATES PATENT AND TRADEMARK OFFICE

CERTIFICATE OF CORRECTION

PATENT NO. : 4,552,541

DATED : November 12, 1985

INVENTOR(S) : PETER BOLLI

It is certified that error appears in the above-identified patent and that said Letters Patent is hereby corrected as shown below:

The Assignee's name has been omitted. Please insert --Assignee: Interlego A.G., Baar, Switzerland--.

Signed and Sealed this

Twenty-first Day of October, 1986

[SEAL]

*Attest:*

DONALD J. QUIGG

*Attesting Officer* *Commissioner of Patents and Trademarks*